US006279428B1

(12) United States Patent
Huang

(10) Patent No.: US 6,279,428 B1
(45) Date of Patent: Aug. 28, 2001

(54) RATCHET WRENCH

(76) Inventor: Chin-Tan Huang, No. 39, Lane 240, Li-Jen RD., Ta-Li City, Taichung Hsien (TW)

( * ) Notice: Subject to any disclaimer, the term of this patent is extended or adjusted under 35 U.S.C. 154(b) by 0 days.

(21) Appl. No.: 09/429,345

(22) Filed: Oct. 28, 1999

(51) Int. Cl.[7] ..... B25B 13/46
(52) U.S. Cl. ..... 81/63.1; 192/43.2
(58) Field of Search ..... 81/62, 63.1; 192/43.2

(56) References Cited

U.S. PATENT DOCUMENTS 2,193,984 * 3/1940 Rhinevault ..... 81/63.1 X
2,201,827 * 5/1940 Froeschl et al. ..... 81/63.1 X
5,174,176 * 12/1992 Krivec ..... 81/62 X
6,047,802 * 4/2000 Huang ..... 81/63.1 X

* cited by examiner

*Primary Examiner*—James G. Smith
(74) *Attorney, Agent, or Firm*—Rosenberg, Klein & Lee

(57) ABSTRACT

A ratchet wrench including a main body, a ratchet, a switching unit and two stopper members. The stopper members are slidable within the recesses of the main body to abut against the ratchet so that the ratchet can be only one-way rotated. The ratchet wrench is applicable to the ratchet with teeth projecting from outer side thereof. The stopper members are supported by the main body and the guide block and firmly located. Therefore, the ratchet wrench is able to bear greater working torque and achieve better using effect.

7 Claims, 8 Drawing Sheets

RATCHET WRENCH

BACKGROUND OF THE INVENTION

The present invention relates to a ratchet wrench which is able to bear greater working torque and achieve better using effect.

FIG. 7 shows a conventional ratchet wrench including a grip 9 and a ratchet 91. Two clicks 92 are symmetrically pivotally disposed at one end of the grip 9 near the ratchet 91. The free ends 921 of the two clicks 92 are able to respectively engage with the teeth 93 of the ratchet 91. A spring 95 is disposed between each click 92 and a fitting member 94 fitted around the wrench. The spring 95 resiliently makes the click 92 engage with the teeth 93 of the ratchet 91 and permits the click 92 to be outward swung. Furthermore, a swinging block 96 is disposed between the two clicks 92. The swinging block 96 serves to swing left and right to respectively push one click 92 away and permit the other click 92 to engage with the ratchet 91, whereby the ratchet 91 can be only one-way rotated.

The clicks 92 are pivotally connected with the grip 9 to swing and engage with the ratchet 91. However, when rotating the wrench with a great strength and the ratchet 91 is subject to a considerably great force, the click 92 may be outward biased and disengaged from the ratchet 91 (as shown in FIG. 8) or the pivot section of the click 92 may be broken and unable to engage with the ratchet 91.

SUMMARY OF THE INVENTION

It is therefore a primary object of the present invention to provide a ratchet wrench in which two stopper members are slidable within the recesses of the main body to abut against the ratchet so that the ratchet can be only one-way rotated. The stopper members are supported by the main body and the guide block and firmly located. It is impossible for the stopper members to displace outward. Therefore, in the case that the wrench is rotated by a greater force in working, the stopper members can also bear the greater force exerted onto the ratchet. Accordingly, the ratchet wrench can bear creater working torque to improve using effect of the ratchet wrench.

It is a further object of the present invention to provide the above ratchet wrench which is applicable to the ratchet with teeth projecting from outer side thereof.

According to the above objects, the ratchet wrench of the present invention includes:

- a main body for a user to grip and wrench, a front end of the main body being formed with a receiving chamber equipped with a cover body, the main body and the cover body being respectively formed with two fitting holes at the receiving chamber, a back side of the main body being disposed with a grip section, two sides of the receiving chamber being respectively formed with two recesses;
- a ratchet located in the receiving chamber of the main body, the ratchet having multiple teeth projecting outward, the ratchet having over one fitting section for fitting into the fitting holes of the main body and the cover body;
- a switching unit which is a switching button for driving an engaging block, two sides of the engaging block being respectively formed with two hook sections; and
- two stopper members respectively disposed in the recesses of the main body, an inner side of each stopper member being formed with an engaging section, a front end of each stopper member being formed with a stopper section, the hook section of the switching unit driving the engaging section of the stopper member, whereby the stopper sections are slidable within the recesses the stopper members respectively abut against the teeth of the ratchet, permitting the ratchet to only one-way rotate.

The present invention can be best understood through the following description and accompanying drawings wherein:

DETAILED DESCRIPTION OF THE PREFERRED EMBODIMENT

Figure 1:
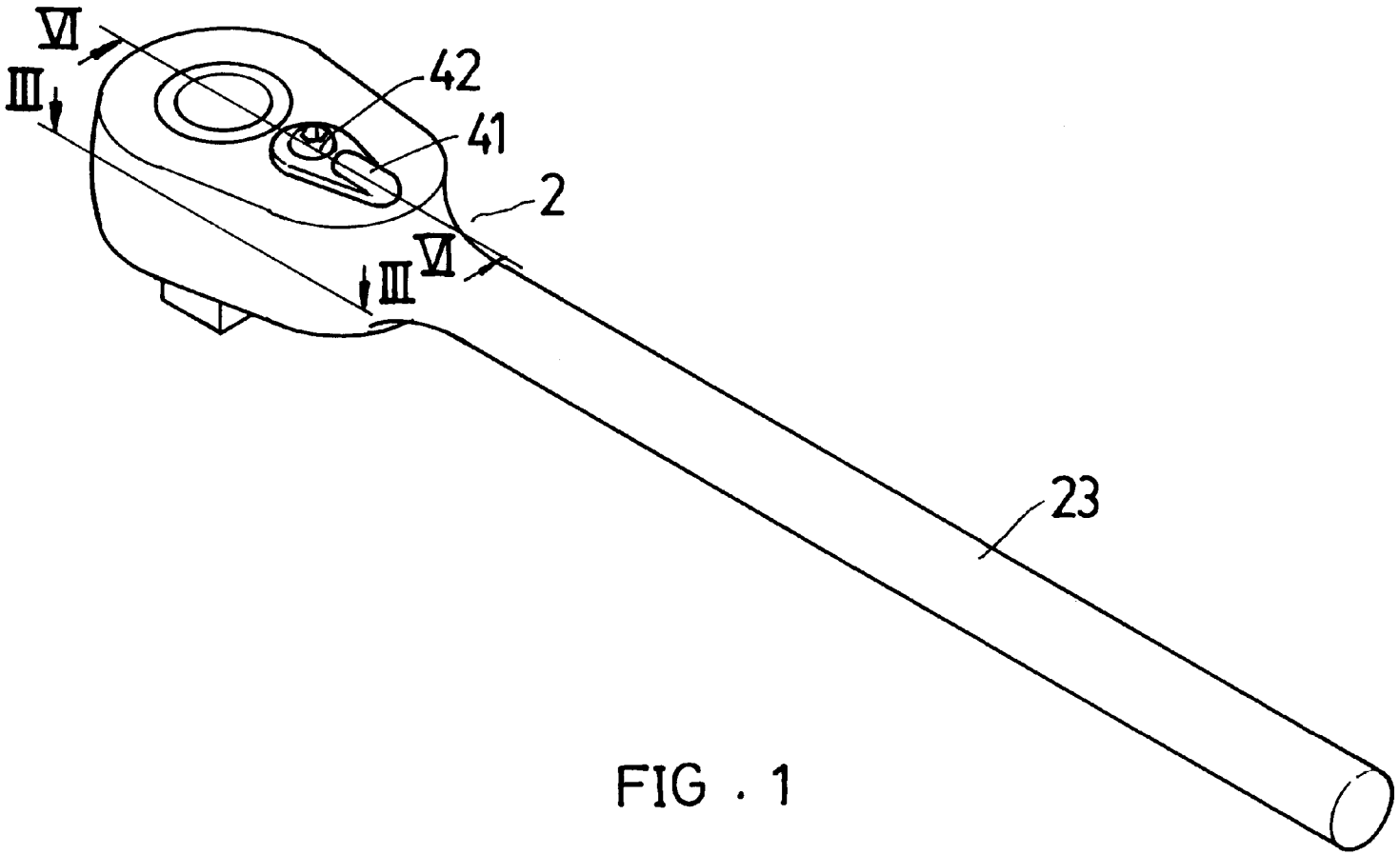
FIG. 1 is a perspective assembled view of the ratchet wrench of the present invention.
Figure 2:
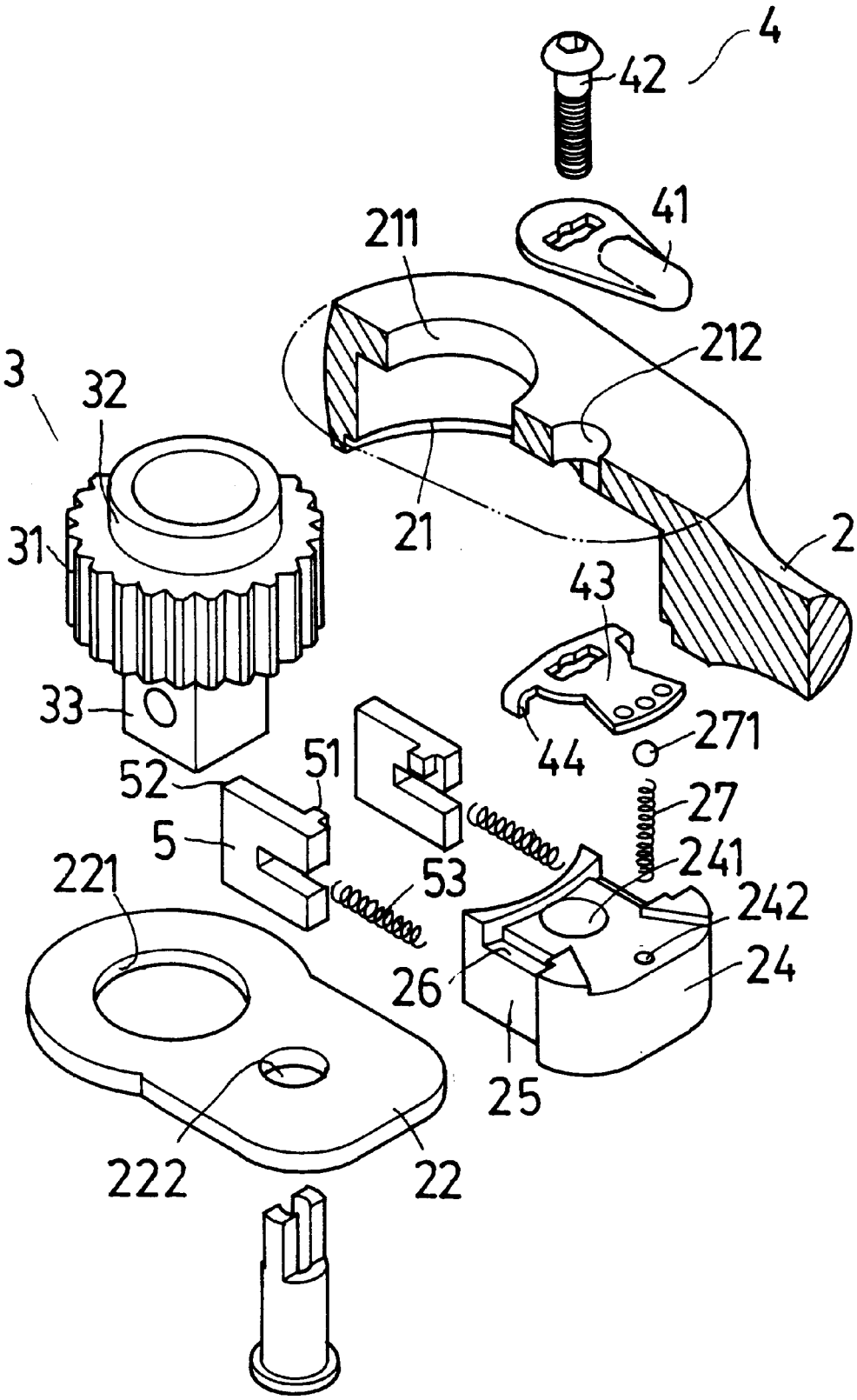
FIG. 2 is a perspective exploded view of the ratchet wrench of the present invention.

Please refer to FIGS. 1 to 6. According to a preferred embodiment, the ratchet wrench of the present invention includes:

- a main body 2, a front end of the main body 2 being formed with a receiving chamber 21 equipped with a cover body 22, the main body 2 and the cover body 22 being respectively formed with two fitting through holes 211, 221 at the receiving chamber 21, the main body 2 and the cover body 22 being additionally formed with two switching holes 212, 222 on lower sides of the fitting holes 211, 221, a back side of the main body 2 being disposed with a grip section 23, a rear end of the receiving chamber 21 being disposed with a guide block 24, two sides of the guide block 24 being respectively formed with two recesses 25, the periphery of the recess 25 being disposed with an elongated guide section 26, the guide block 24 being formed with a switching hole 241 between the two recesses 25, a lower side of the switching hole 241 being further formed with a stopper hole 242, a second resilient member 27 being positioned in the stopper hole 242 for pushing a ball member 271, in this embodiment, the second resilient member 27 being a compression spring;
- a ratchet 3 located in the receiving chamber 21 of the main body 2, the ratchet 3 having multiple teeth 31 projecting outward, two sides of the teeth 31 being respectively formed with two fitting sections 32 for fitting into the fitting holes 211, 221 of the main body 2 and the cover body 22, in this embodiment, a connecting rod 33 laterally extending from a middle section of the ratchet 3;
- a switching unit 4 which is a switching button 41 in this embodiment, a fixing bolt 42 being disposed at a middle section of the switching button 41, the fixing bolt 42 being drivingly connected with an engaging block 43 and passed through the switching holes 212, 241, 222 of the main body 2, guide block 24 and cover body 22, two sides of the engaging block 43 being respectively formed with two hook sections 44, a rear end of the engaging block 43 being formed with a first, a second and a third travel dents 451, 452, 453 against which the ball member 271 of the main body 2 abuts; and two stopper members 5 respectively disposed in the recesses 25 of the guide block 24 disposed in the receiving chamber 21 of the main body 2, an inner side of each stopper member 5 being formed with a projecting engaging section 51 positioned in the guide section 26 of the recess 25, whereby the stopper member 5 can slide within the recess 25, a front end of the stopper member 5 being formed with a stopper section 52, the hook section 44 of the switching unit 4 driving the engaging section 51 of the stopper member 5 to make the stopper sections 52 respectively abut against the teeth 31 of the ratchet 3, permitting the ratchet 3 to only one-way rotate, a rear end of the stopper member 5 being disposed with a first resilient member 53 for keeping the stopper member 5 at a position where the stopper member 5 abuts against the teeth 31 of the ratchet 3, the first resilient member 53 being a compression spring.

Figure 3:
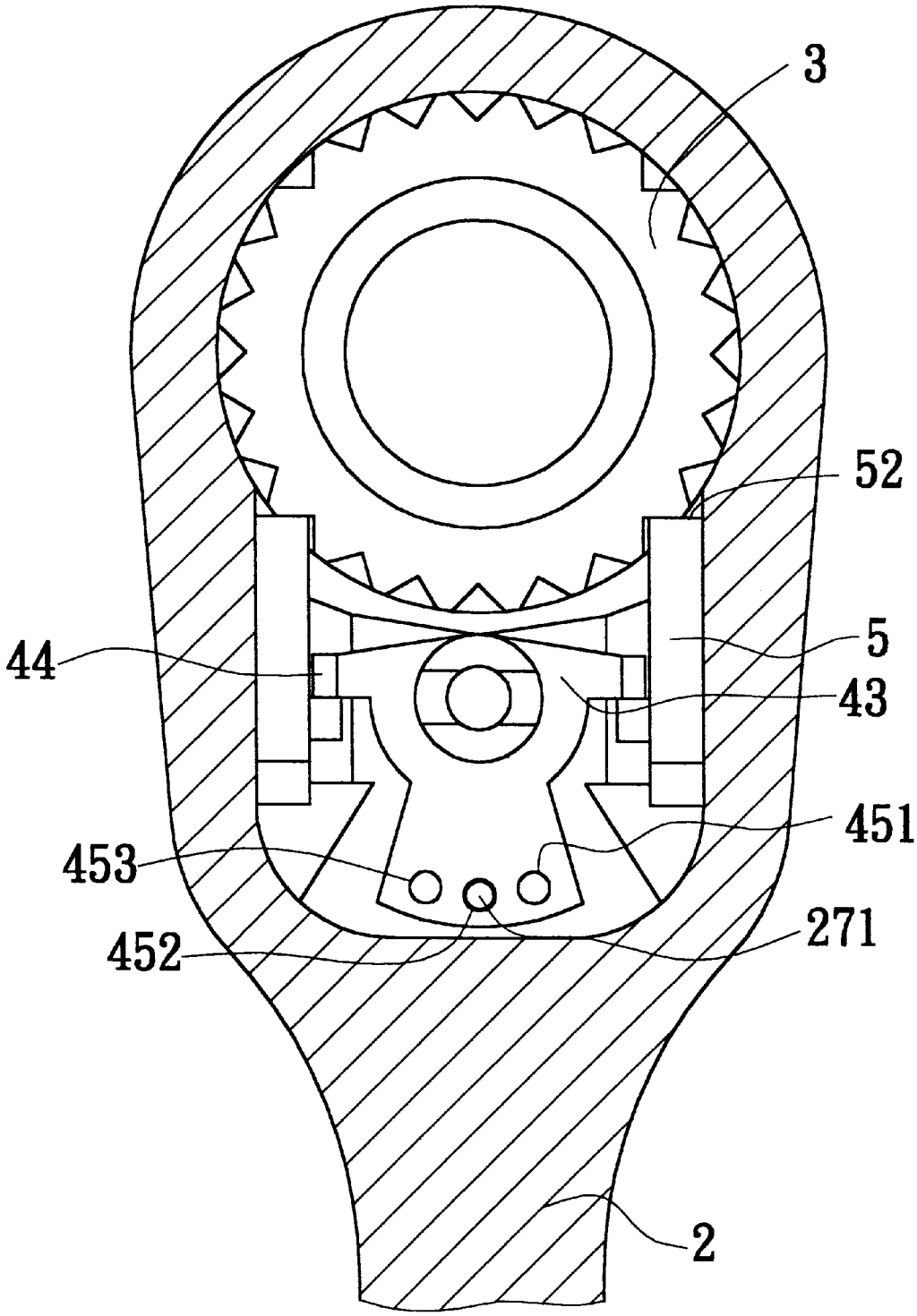
FIG. 3 is a sectional view taken along line III—III of FIG. 1.
Figure 4:
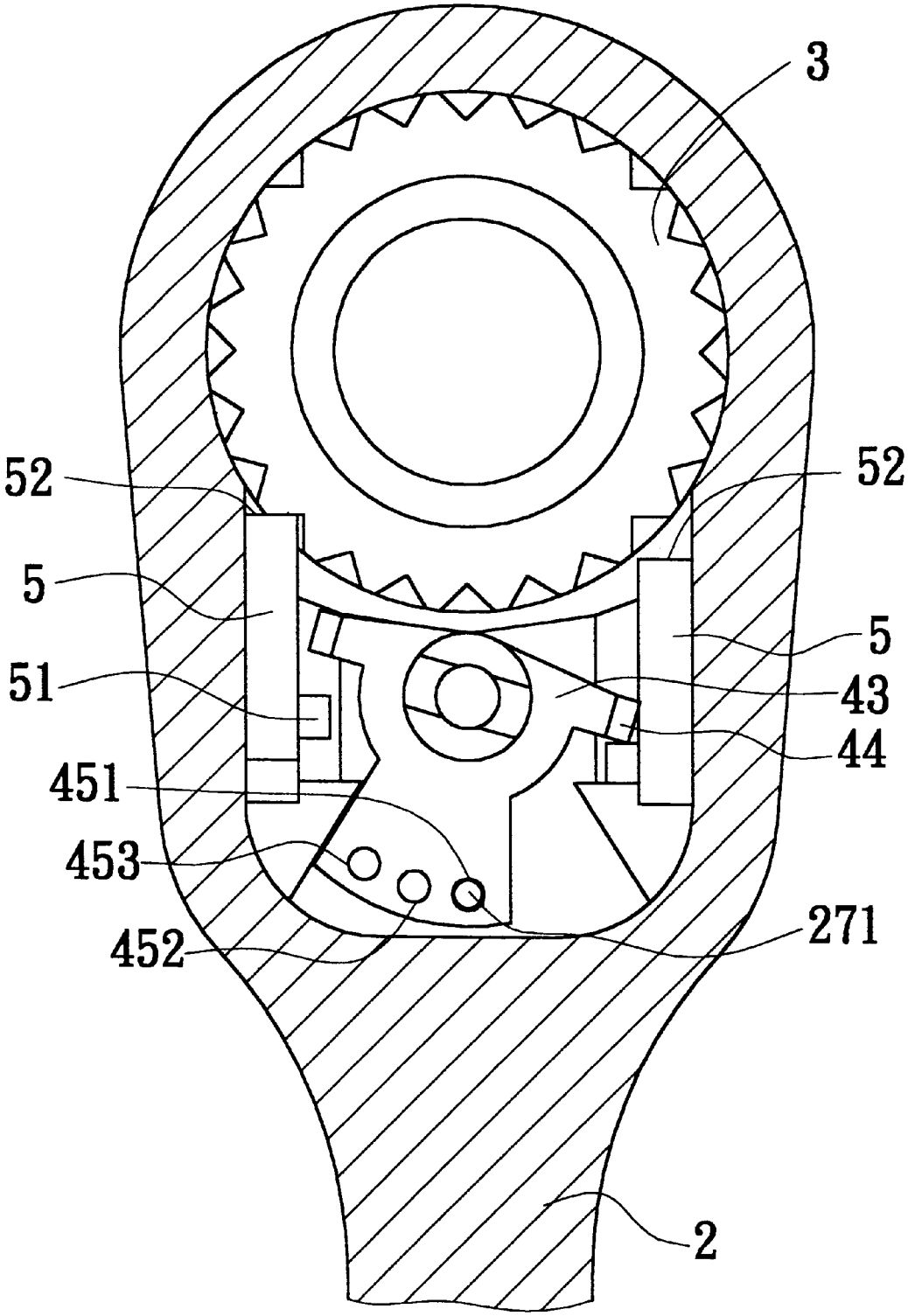
FIG. 4 shows the switching operation of the ratchet wrench of the present invention in one state.
Figure 5:
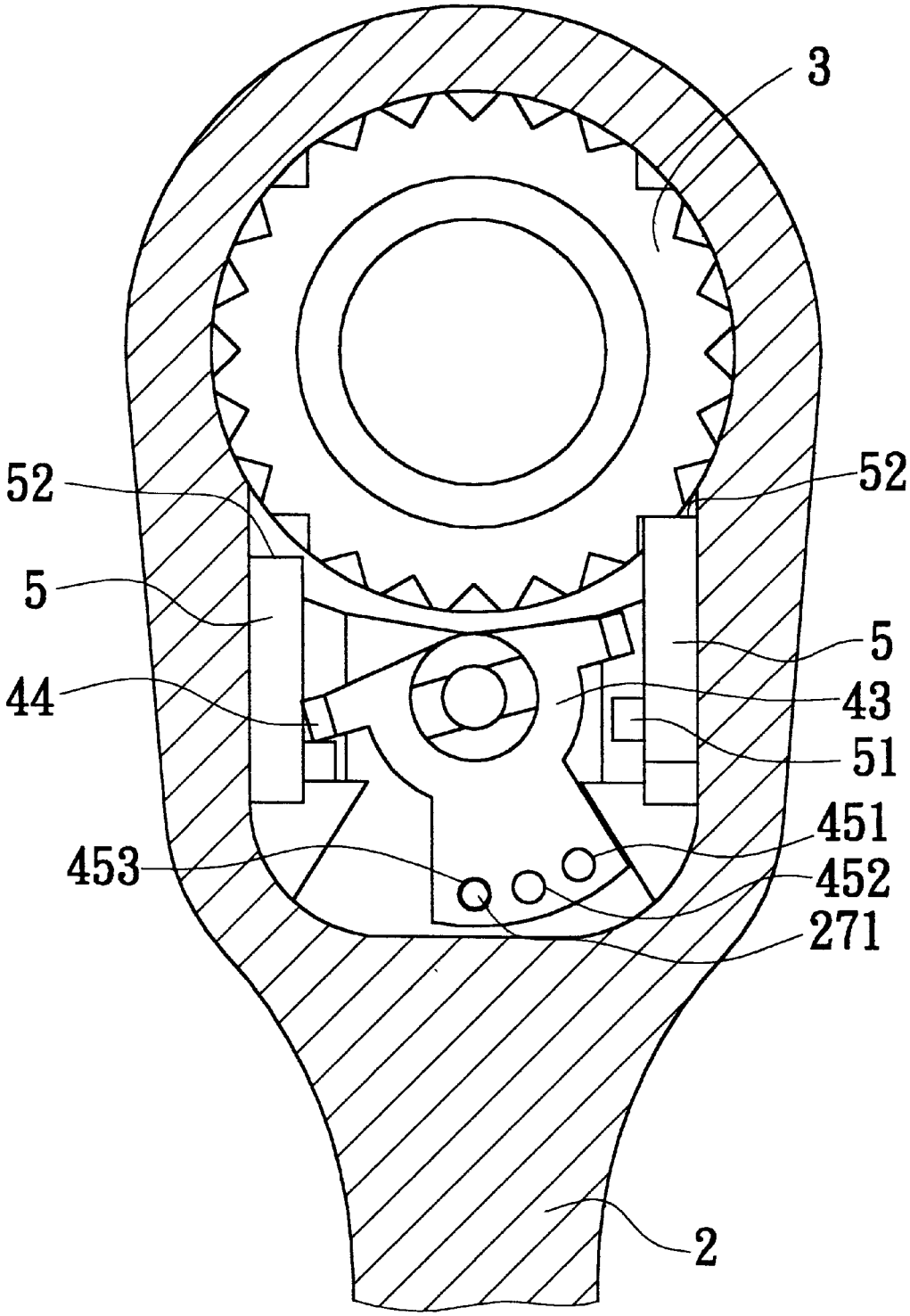
FIG. 5 shows the switching operation of the ratchet wrench of the present invention in another state.
Figure 6:
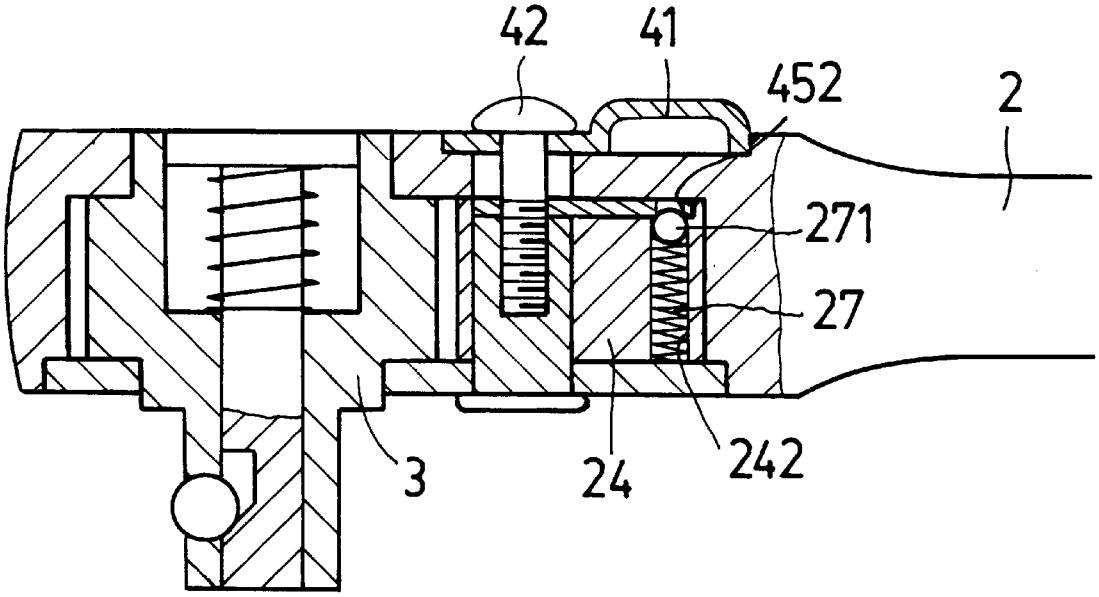
FIG. 6 is a sectional view taken along line VI—VI of FIG. 1.
Figure 7:
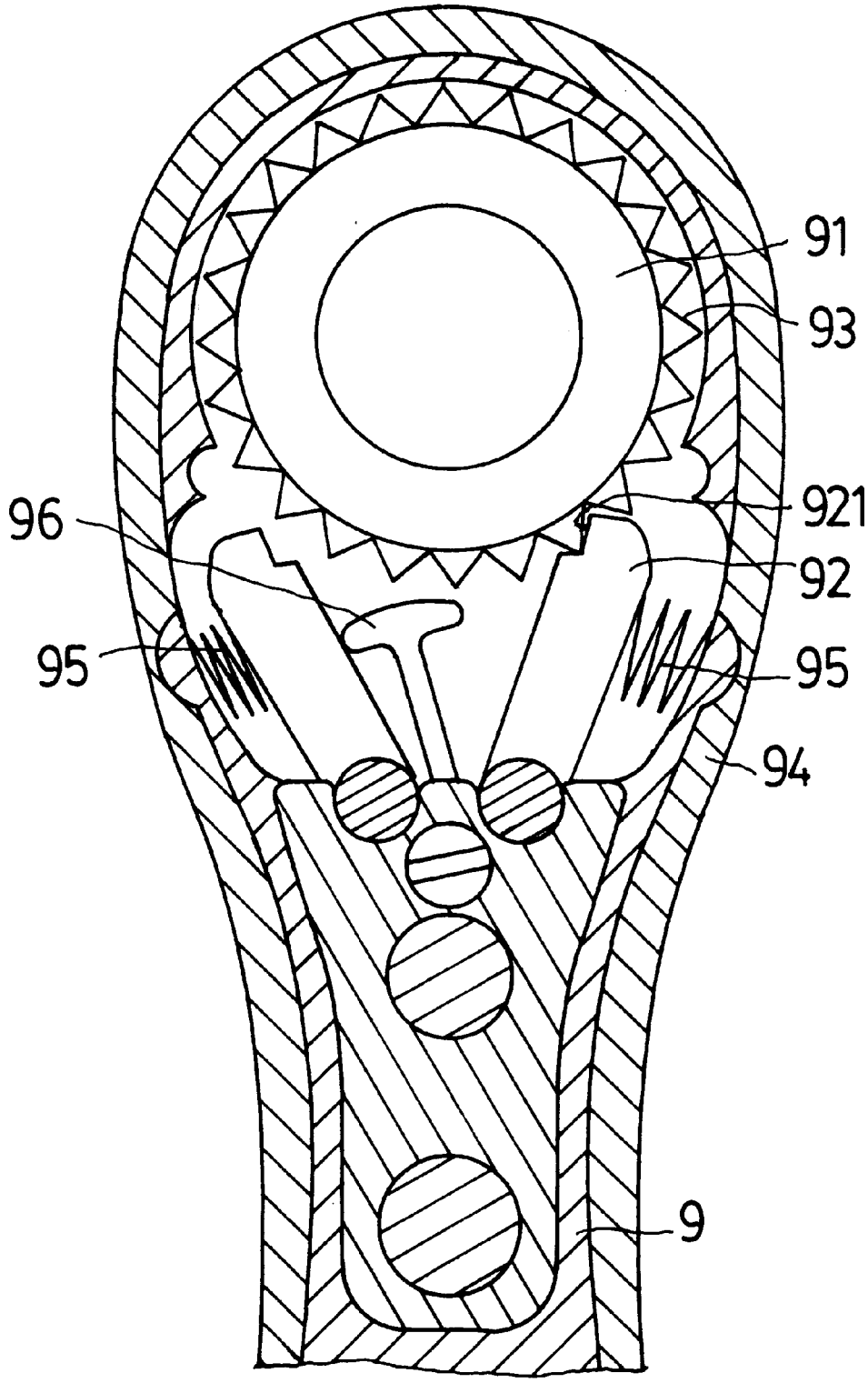
FIG . 7 PRIOR ART
FIG. 7 is a sectional view of a conventional ratchet wrench.
Figure 8:
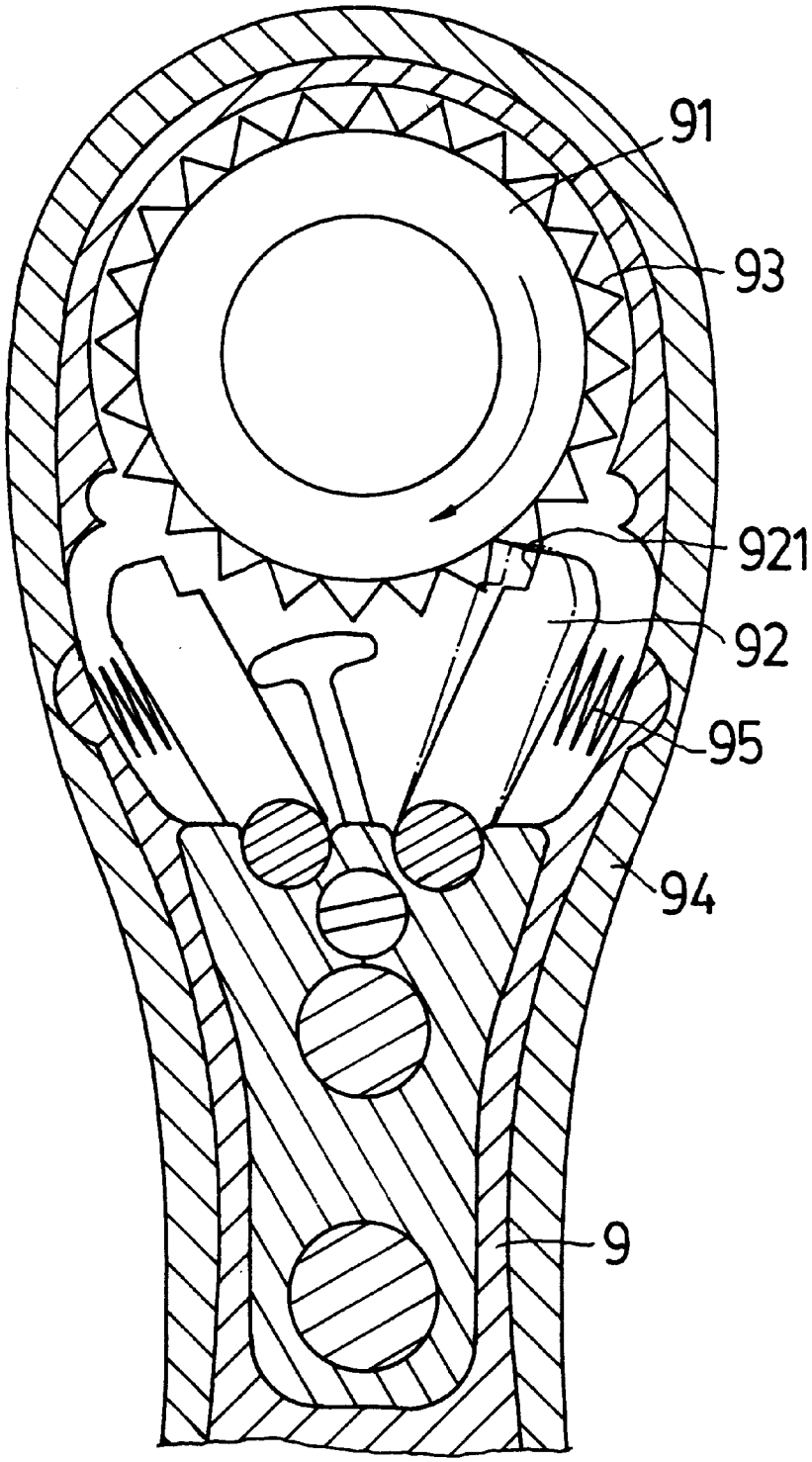
FIG 8 PRIOR ART
FIG. 8 shows the operation of the conventional ratchet wrench.

When shifting the switching unit 4, the switching button 41 drives the engaging block 43. The switching position of the engaging block 43 is guided by the first, second and third travel dents 451, 452 and 453. As shown in FIG. 4, when the ball member 271 abuts against the first travel dent 451, the hook section 44 of one side of the engaging block 43 is positioned on front side, while the hook section 44 of the other side is positioned on rear side, The hook section 44 of front side drives the stopper member 5 on this side to move forward, making the stopper section 52 of the stopper member 5 engage with the teeth 31 of the ratchet 3, whereby the ratchet 3 can only clockwise rotate. The hook section 44 on rear side drives the stopper member 5 on this side to move backward, making the stopper section 52 of the stopper member 5 disengage from the teeth 31 of the ratchet 3. Reversely, as shown in FIG. 5, when the ball member 271 abuts against the third travel dent 453, the hook section 44 of the other side of the engaging block 43 is positioned on front side, while the hook section 44 of one side of the engaging block 43 is positioned on rear side, The hook section 44 of front side drives the stopper member 5 on this side to move forward, making the stopper section 52 of the stopper member 5 engage with the teeth 31 of the ratchet 3, whereby the ratchet 3 can only counterclockwise rotate. When the ball member 271 abuts against the second travel dent 452, as shown in FIG. 3, the stopper sections 52 of both stopper members 5 abut against the teeth 31 of the ratchet 3 so that the ratchet 3 cannot rotate.

By means of the stopper members 5 which are slidable within the recesses 25 to abut against the ratchet 3, the ratchet 3 can be only one-way rotated. Therefore, no matter whether the stopper members 5 abut against the ratchet 3, the stopper members 5 are restricted and supported by the main body 2 and the guide block 24 with great force so that the stopper members 5 can be firmly located. Moreover, it is impossible for the stopper members 5 to displace outward. Therefore, in the case that the wrench is rotated by a greater force in working, the stopper members 5 can also bear the greater force exerted onto the ratchet 3. Accordingly, the ratchet wrench can bear greater working torque. In addition, the teeth of the ratchet 3 of the present invention project from outer side thereof so that the wrench is applicable to a work piece which is inserted with the middle section of the ratchet 3.

In conclusion, the stopper members 5 which are slidable within the recesses 25 to abut against the ratchet 3 so that the ratchet 3 can be only one-way rotated. The ratchet wrench of the present invention is applicable to the ratchet with teeth projecting from outer side thereof. The stopper members 5 are supported by the main body 2 and the guide block 24 and firmly located. Therefore, the ratchet wrench of the present invention is able to bear greater working torque and achieve better using effect.

The above embodiment is only used to illustrate the present invention, not intended to limit the scope thereof. Many modifications of the above embodiment can be made without departing from the spirit of the present invention.

What is claimed is:

1. A ratchet wrench comprising:

(a) a main body including a front end section and a grip section extending therefrom, said front end section having an inner wall portion defining a receiving chamber, said main body having formed therethrough a first fitting hole;

(b) a cover body coupled to said main body front end section to at least partially enclose said receiving chamber, said cover body having formed therethrough a second fitting hole;

(c) a ratchet rotatably disposed within said receiving chamber of said main body front end section, said ratchet having formed thereon a plurality of radially extending teeth, said ratchet having an axially extended fitting section for engaging said first and second fitting holes;

(d) a pair of stopper members each slidably disposed against said inner wall portion of said main body front end section, each said stopper member being selectively displaceable between first and second positions, each said stopper member including a stopper end section and a transversely extended engaging section, said stopper end section lockingly engaging at least one said ratchet tooth in said first position and being disengaged from said ratchet teeth in said second position;

(e) a switching unit coupled to said stopper members for controlling said displacement thereof, said switching unit including an adjustable engaging block, said engaging block having a pair of hook sections extending therefrom for respectively engaging said engaging sections of said stopper members, said hook sections being displaceable to selectively drive said stopper members to at least one of said first and second positions thereof; and, (f) a guide block disposed in said receiving chamber of said main body front end section between said stopper members, said guide block having a pair of recesses formed on opposing sides thereof for slidably receiving said stopper members respectively therein, whereby the rotation of said ratchet is selectively limited.

2. The ratchet wrench as recited in claim 1 wherein said guide block has formed in each said recess an elongated guide section for slidably receiving therein said engaging section of one said stopper member.

3. The ratchet wrench as recited in claim 1 wherein said engaging block of said switching unit is pivotally coupled to said guide block, said engaging block being displaceable between a plurality of angular positions, said engaging block having formed therein a plurality of travel dents.

4. The ratchet wrench as recited in claim 3 wherein said switching unit further includes a ball captured between said engaging block and said guide block, said ball engaging in resiliently biased manner one of said engaging block travel dents for releasably locking said engaging block in one of said angular positions thereof.

5. The ratchet wrench as recited in claim 4 wherein guide block has formed therein a stopper hole, said ball of said switching unit being resiliently supported by a resilient member disposed in said stopper hole.

6. The ratchet wrench as recited in claim 5 wherein said resilient member supporting said switching unit ball is a compression spring.

7. The ratchet wrench as recited in claim 1 further comprising a switching button pivotally coupled to said main body by a fixing bolt, said fixing bolt passing through a switching hole formed in said main body, and through said engaging block to engage a switching hole formed in said guide block between said recesses thereof.

* * * * *